US012649081B2

(12) United States Patent
Wang

(10) Patent No.: US 12,649,081 B2
(45) Date of Patent: Jun. 9, 2026

(54) THREE-IN-ONE FITNESS EQUIPMENT

(71) Applicant: Shenzhen Shenlaiyibi Technology Co., Ltd., Shenzhen (CN)

(72) Inventor: Longfei Wang, Shenzhen (CN)

(73) Assignee: Shenzhen Shenlaiyibi Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/401,308

(22) Filed: Dec. 29, 2023

(65) Prior Publication Data

US 2024/0131385 A1 Apr. 25, 2024

(30) Foreign Application Priority Data

Nov. 17, 2023 (CN) ..... 202311545472.0

(51) Int. Cl.
*A63B 21/072* (2006.01)
*A63B 21/06* (2006.01)
*A63B 21/075* (2006.01)

(52) U.S. Cl.
CPC ..... *A63B 21/0722* (2015.10); *A63B 21/0605* (2013.01); *A63B 21/0728* (2013.01); *A63B 21/075* (2013.01)

(58) Field of Classification Search
CPC ..... A63B 21/075; A63B 21/0728; A63B 21/0605; A63B 21/0722
USPC ..... 482/106, 107
See application file for complete search history.

(56) References Cited

U.S. PATENT DOCUMENTS

| | | | | |
|---|---|---|---|---|
| 793,101 | A * | 6/1905 | Schmidt | A61H 7/007 482/108 |
| 7,381,157 | B2 * | 6/2008 | Blateri | A63B 21/075 482/106 |
| 9,694,236 | B2 * | 7/2017 | Rost | A63B 22/16 |
| 11,878,201 | B2 * | 1/2024 | Sisler | A63B 21/075 |
| 2014/0135186 | A1 * | 5/2014 | Reynolds | A63B 21/072 482/108 |
| 2015/0105224 | A1 * | 4/2015 | Odneal | B22D 17/00 164/47 |
| 2015/0343257 | A1 * | 12/2015 | Cooper | A63B 21/0609 482/93 |

* cited by examiner

*Primary Examiner* — T. Scott Fix
(74) *Attorney, Agent, or Firm* — ScienBiziP, P.C.

(57) ABSTRACT

The present disclosure provides a three-in-one fitness equipment, including a weight box configured for receiving at least one weight plate, a first installation position provided on one end of the weight box and configured for installing a handle thereon, and a second installation position provided at a center of bottom of the weight box and configured for connecting to a rod-shaped holding member. The fitness equipment is a kettlebell when the first installation position is installed with the handle, and the fitness equipment is a dumbbell or a barbell when the second installation position is connected to the rod-shaped holding member. The present disclosure provides the weight box as a foundation component configured for assembling with a handle or a rod, and further provides a locking device to fulfill the quick assembly of the box body and the box base when converting a dumbbell or barbell into a kettlebell.

8 Claims, 16 Drawing Sheets

THREE-IN-ONE FITNESS EQUIPMENT

CROSS-REFERENCES TO RELATED APPLICATIONS

This application claims the benefit of priority to Chinese Patent Application Number 202311545472.0, filed on Nov. 17, 2023, in the China National Intellectual Property Administration. The entire contents of the above-identified application are hereby incorporated by reference.

TECHNICAL FIELD

The present disclosure relates to the field of fitness equipment, particularly relates to a three-in-one fitness equipment.

BACKGROUND

Dumbbells, kettlebells, barbells are common fitness equipment that can effectively exercise arms and chest muscles after long-term use, therefore are favored by fitness enthusiasts. At present, a single dumbbell, a single kettlebell or a single barbell has the limitations of a fixed appearance and structure, a single function, and the inability to share components and the inability to adjust weight.

In order to overcome the above-mentioned limitations, prior art in the related fields assembles dumbbells, kettlebells and barbells in different ways to meet respective fitness needs. For example, the Chinese utility model patent application number 201921294793.7 discloses a non-cast and assemblable multipurpose kettlebell. However, in the above-mentioned prior art, when dumbbells or barbells need to be used for fitness, the spherical devices at both ends are in a state of constant weight, and the weight cannot be adjusted according to needs, resulting in the inability to meet the user's fitness needs for different weights. In another prior art, Chinese utility model patent application number 201120551185.7, discloses a multifunctional combined kettlebell, in which a combination method to assemble different equipment is disclosed. However, in the above mentioned second prior art, when the kettlebell is converted into a dumbbell, it is necessary to disassemble the two outer hemispheres of the kettlebell, a process may require a long time to assemble and dis-assemble due to the complexity of the equipment.

SUMMARY OF THE DISCLOSURE

The present disclosure proposes a three-in-one fitness equipment that is multifunctional, convenient to disassemble and assemble, and easy to adjust weight.

The present disclosure is implemented in the embodiments described as follows:

A three-in-one fitness equipment includes a weight box configured for receiving at least one weight plate, a first installation position provided on one end of the weight box and configured for installing a handle thereon, and a second installation position provided at a center of bottom of the weight box and configured for connecting to a rod-shaped holding member. The fitness equipment is a kettlebell when the first installation position is installed with the handle, and the fitness equipment is a dumbbell or a barbell when the second installation position is connected to the rod-shaped holding member.

As a further optimization, the weight box includes a box body and a box base which is detachably connected with the box body; a threaded rod provided at center position of bottom of the box base, of which upper end extended to upper position of the box body; and a locking device arranged on the box body and configured for connecting with the threaded rod, so as to lock the box body with the box base.

As a further optimization, the threaded rod includes an annular groove on an outer diameter position of an upper end of the threaded rod. The locking device includes a lock tongue arranged around the threaded rod. The lock tongue is connectable to the box body. The lock tongue is rotatable around a center of the threaded rod and movable horizontally. An end of the lock tongue is insertable into the annular groove. The threaded rod is connected with the box body when the end of the lock tongue is inserted into the annular groove.

As a further optimization, the locking device further includes a rotary knob, positioned above the box body and connected with the box body through a threaded connection, to drive the lock tongue to rotate around the center of the threaded rod; a limiting plate is provided inside the box body and connected with the rotary knob; a locking member is installed between the limiting plate and the rotary knob; the lock tongue is slidably installed inside the locking member, and when the rotary knob rotates, it can drive the lock tongue to rotate around the center of the threaded rod.

As a further optimization, the box body includes a step portion including a center hole and an internal thread. The step portion is inwardly recessed at a center of an upper part of the box body. The rotary knob is positioned beneath the step portion and connected with the internal thread of the step portion. The box body further includes a limiting convex bar protruding towards an internal space of the box body, the limiting convex bar being arranged at a lower part of the step portion. The limiting bar includes a forcing end which is tangent to an inner diameter of the step portion, and a loosening end which is away from a center hole of the step portion. The forcing end is smoothly transitioned to the loosening end, and when the lock tongue rotates around the center of the box body, the lock tongue moves in a horizontal direction as the lock tongue sequentially coming into contact with the forcing end and the loosening end of the limiting convex bar.

As a further optimization, the lock tongue includes a driving end contacting with the limiting convex bar, and a locking end away from the driving end, and the locking end is configured for being inserted into the annular groove provided at the upper end of the threaded rod when the locking end moves horizontally to an extreme position, the extreme position of the locking end is close to a centerline of the box body.

As a further optimization, the box base includes a bottom cover and a top cover connected to the bottom cover by screws. The weight box further includes a positioning plate between the top cover and the bottom cover. The positioning plate is connected to bottom part of the threaded rod. The threaded rod is arranged to extend through the top cover of the box base.

As a further optimization, the first installation position is a screw hole arranged on two sides of the weight box.

As a further optimization, the second installation position is a connection hole defined on a center of the bottom cover of the box base. The connection hole is a threaded hole.

As a further optimization, the rod-shaped holding member is a rod, including a connection rod. Each end of the connection rod is provided with a limiting head. The threaded rod includes a limiting hole. The limiting head is insertable into the limiting hole. The connection rod and the threaded rod rotate synchronously when the limiting head is inserted into the limiting hole. Each end of the connection rod is provided with a groove with a circle configuration. Each end of the connection rod is provided with a locking screw nut. At least one limiting screw is arranged at a radial position of the locking screw nuts, and the at least one limiting screw extends into the groove. The locking screw nuts are rotatably arranged on the second installation position at the bottom of the weight box through a threaded connection. A holding rod is sleeved at a middle position of the connection rod, a center rod is installed at a center of the connection rod, and both ends of the center rod extend to the center of the threaded rod.

As a further optimization, the rod-shaped holding member further comprises an extension rod connected with the rod.

The present disclosure includes the following benefits when using the technical solutions above:

1) The present disclosure provides a weight box as a foundation component, which can be assembled with a handle or a rod according to the users' needs to facilitate fitness activities with kettlebells, dumbbells or barbells, and has the advantage of diverse functions.
2) The present disclosure provides a locking device to fulfill the quick assembly of the box body and box base, which can facilitate the user to quickly disassemble and assemble the box body and the box base. On the one hand, when changing from a dumbbell or barbell to a kettlebell, it can quickly facilitate the assembly of kettlebell and saves time. On the other hand, when used as dumbbells or barbells, the box body can be quickly disassembled according to user needs. It has the advantage of convenient disassembly and assembly, and satisfies users to cancel the structure of the box body when performing dumbbell or barbell activities.
3) The present disclosure sets the weight box on the threaded rod, which can facilitate the user to replace the at least one weight plates in quantity and meet the user's fitness needs for different weights.

DETAILED DESCRIPTION

Figure 1:
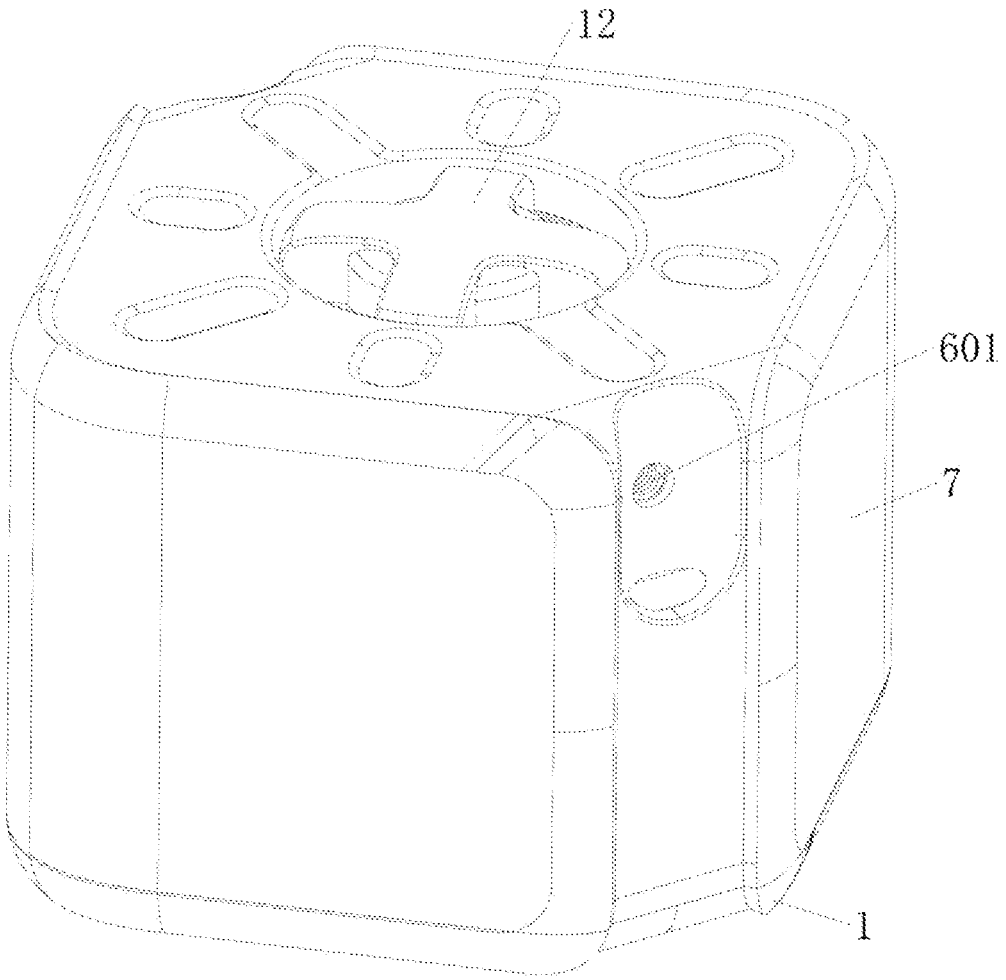
FIG. 1 is a first view of a three-dimensional structure diagram illustrating a weight box according to the present disclosure.
Figure 2:
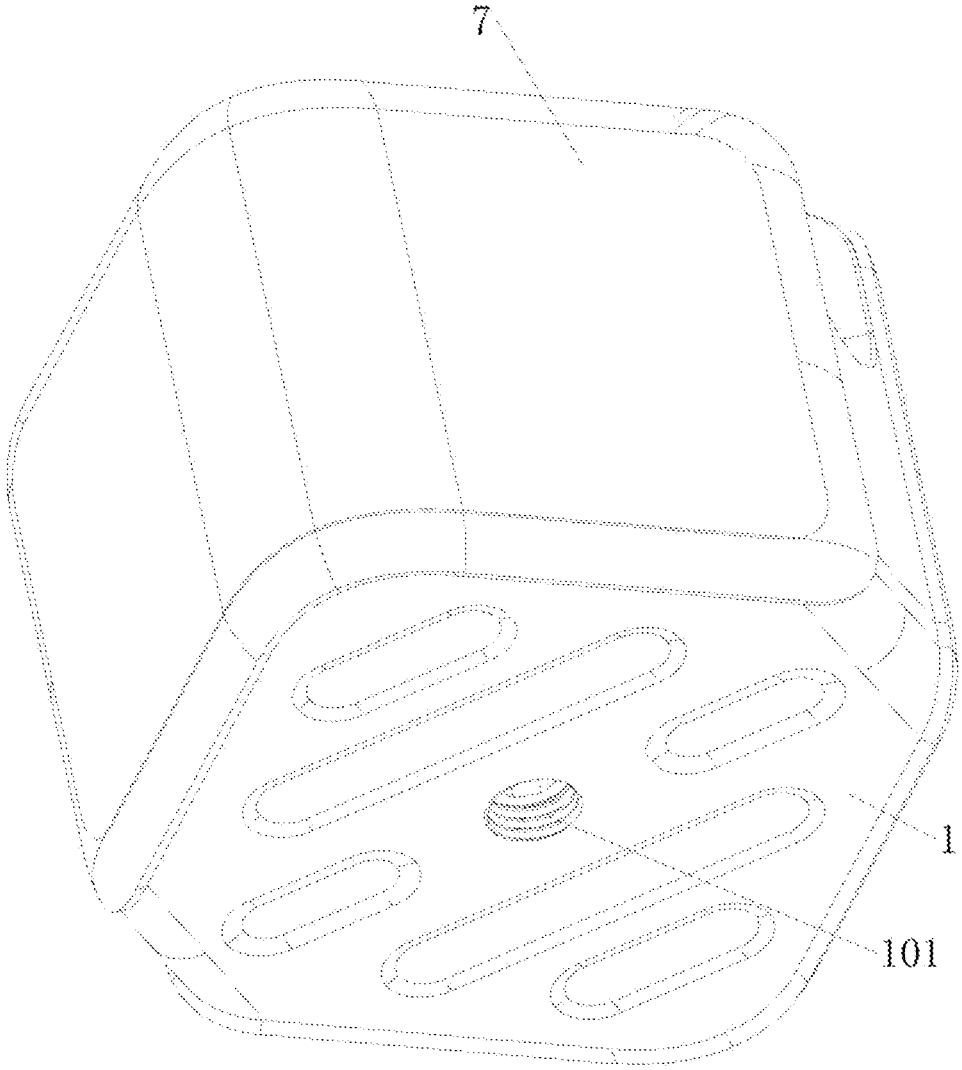
FIG. 2 is a second view of the three-dimensional structure diagram illustrating the weight box shown in FIG. 1.

In order to further describe the technical solutions of the present disclosure, specific embodiments of the present disclosure combined with the accompanying drawings are stand here. It should be understood that the detailed embodiments of the disclosure described here are used to explain the present disclosure only, instead of limiting the present disclosure.

Referring to FIGS. 1-16, the present disclosure provides a three-in-one fitness equipment. The three-in-one fitness equipment includes a weight box configured for receiving at least one weight plate 4. The weight box includes a first installation position provided on one end of the weight box and configured for installing a handle 13 thereon. The fitness equipment is a kettlebell when the first installation position is installed with the handle. Specifically, the first installation position is two screw holes 601 arranged on two sides of the weight box respectively. In this embodiment, two second screw nuts 6 are fixed on two sides of the internal of the weight box respectively. The handle 13 is installable to the screw holes 601 of the second screw nuts 6 through screws. When the handle 13 is installed to the screw holes 601 of the second screw nuts 6 through screws, the handle 13 is installed on the weight box so that the fitness equipment can be used as a kettlebell for fitness activity.

The weight box further includes a second installation position provided at a center of the bottom of the weight box and configured for connecting to a rod-shaped holding member. The fitness equipment is a dumbbell or a barbell when the second installation position is connected to the rod-shaped holding member. In this embodiment, the second installation position is a connection hole 101 defined on a center of a bottom cover 1 of the box base, and the connection hole 601 is a threaded hole.

Specifically, the weight box includes a box body 7, a box base, a threaded rod 2, and a locking device. The box body 7 is arranged above the box base. The threaded rod 2 is installed on the box base, and an upper end of the threaded rod 2 extends to an upper position of the box body 7. The at least one weight plate 4 is configured to be sleeved onto an outside of the threaded rod 2 and fixed by a first screw nut 5. The overall weight of the fitness equipment is configured to be adjusted by changing the quantity of the at least one weight plate 4. The at least one weight plate 4 will not sway inside the box body 7 when the at least one weight plate 4 is fixed by the first screw nut 5 and a rubber pad is defined between the first screw nut 5 and an uppermost weight plate 4. The locking device is positioned on an upper end of the box body 7 and is connected with the threaded rod 2 to facilitate the connection between the box body 7 and the box base. More specifically, one side surface of the at least one weight plate 4 is provided with at least one cylindrical raised block that is outwardly protruding, and another side surface of the at least one weight plate 4 is provided with at least one slot that is inwardly recessed to match the at least one cylindrical raised block. The cylindrical raised block is configured for inserting into the slot, so as to avoid the relative rotation between two adjacent weight plates 4 and further improve the assembly stability of the at least one weight plate 4.

Specifically, the box base includes the bottom cover 1 and a top cover 3 connected to the bottom cover 1 by screws. A positioning plate 201 is provided between the top cover 3 and the bottom cover 1 and is connected to a bottom portion of the threaded rod 2, and the threaded rod 2 is configured to extend through the top cover 3. More specifically, the threaded rod 2 is integrally connected with the positioning plate 201 provided at the bottom portion of the threaded rod 2. The positioning plate 201 is placed in the recessed portion 301 at the center of the bottom of the top cover 3. At an edge of the recessed portion 301 is provided with at least one threaded pillar 302 configured for connecting with the bottom cover 1, and at an edge of the positioning plate 201 is provided with at least one groove 2011. The at least one groove 2011 is corresponding to the at least one threaded pillar 302. The at least one groove 2011 limits the rotation of the positioning plate 201 relative to the top cover 3, so that the threaded rod 2 only has the freedom to move along the internal axis of the recessed portion 301. After connecting the bottom cover 1 and the top cover 3 by screws, the threaded rod 2 is fixed.

Specifically, the locking device includes a rotary knob 12 arranged above the box body 7. The rotary knob 12 includes an upper housing 1201 and a lower housing 1202 connected with the upper housing 1201 in a synchronously rotation. The lower end of the rotary knob 12 is connected with a locking member 11. The locking member 11 is integrally connected to the lower housing 1202, and a lock tongue 10 is defined inside the locking member. In this embodiment, the locking member 11 is integrally arranged on a bottom of the lower housing 1202. The lock tongue 10 is configured to move in a horizontal direction. In this embodiment, the number of the locking member 11 and the lock tongue 10 is two, and they are evenly distributed around the center of the rotary knob 12 to improve the working performance during locking. A limiting plate 8 is connected to a lower end of the rotary knob 12 and arranged in the box body 7. More specifically, one side of the locking member 11 is provided with a stop plate 1101. The lock tongue 10 is arranged in the locking member 11. A spring 9 is provided between the stop plate 1101 and the lock tongue 10, one end of the spring 9 abuts to a step in the middle part of the lock tongue 10, and another end abuts to an inner surface of the stop plate 1101. An inner end of the lock tongue 10 passes through a hole defined on the stop plate 1101 and then inserts into an annular groove 202 defined on the threaded rod 2. When the lock tongue 10 is in a free state, the spring 9 drives the lock tongue 10 to the outer limit position.

Figure 5:
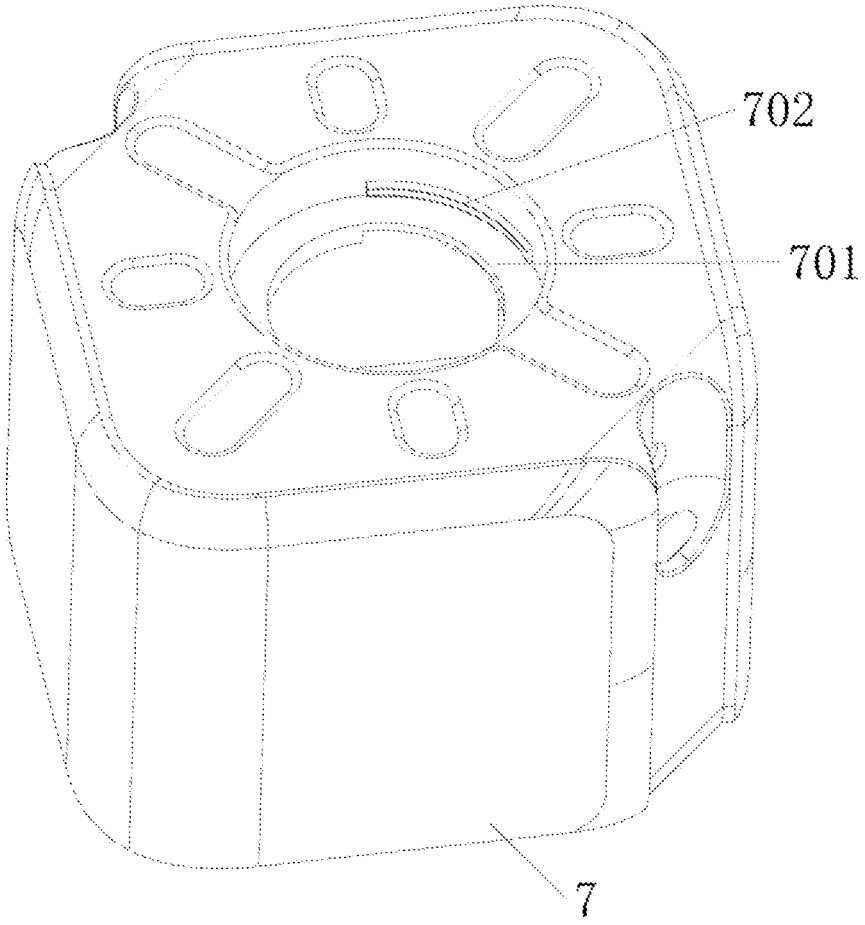
FIG. 5 is a first view of a three-dimensional structure diagram illustrating a box body of the weight box shown in FIG. 1.
Figure 6:
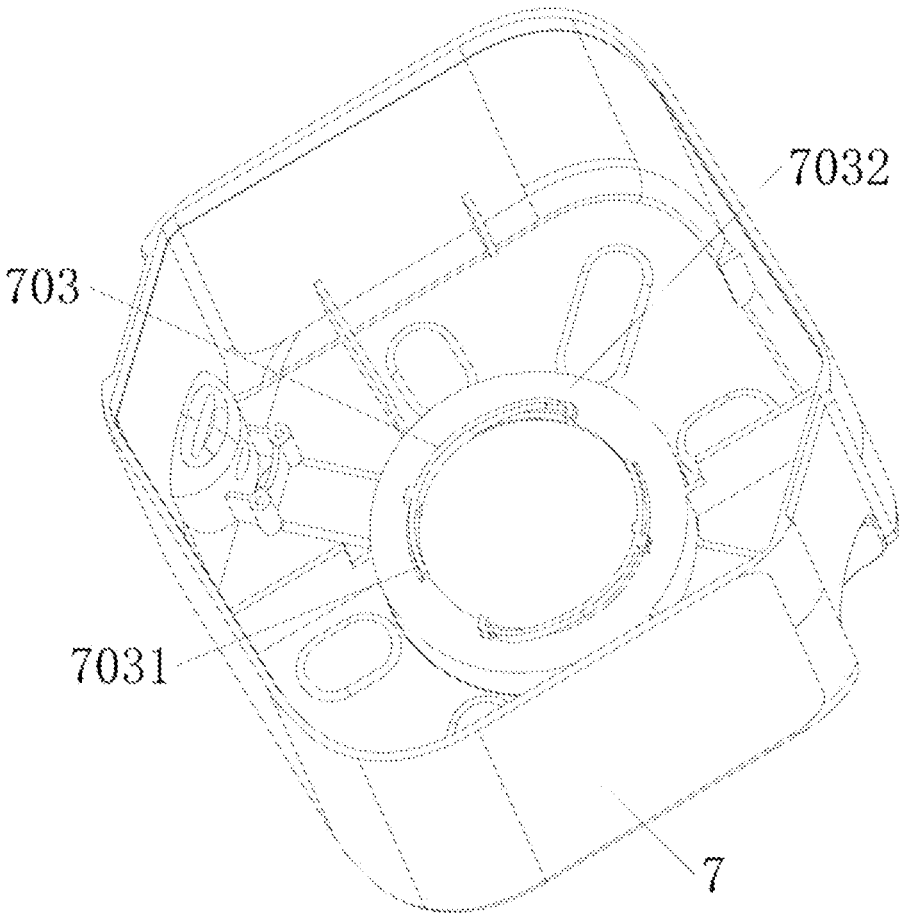
FIG. 6 is a second view of the three-dimensional structure diagram illustrating the box body shown in FIG. 5.
Figure 7:
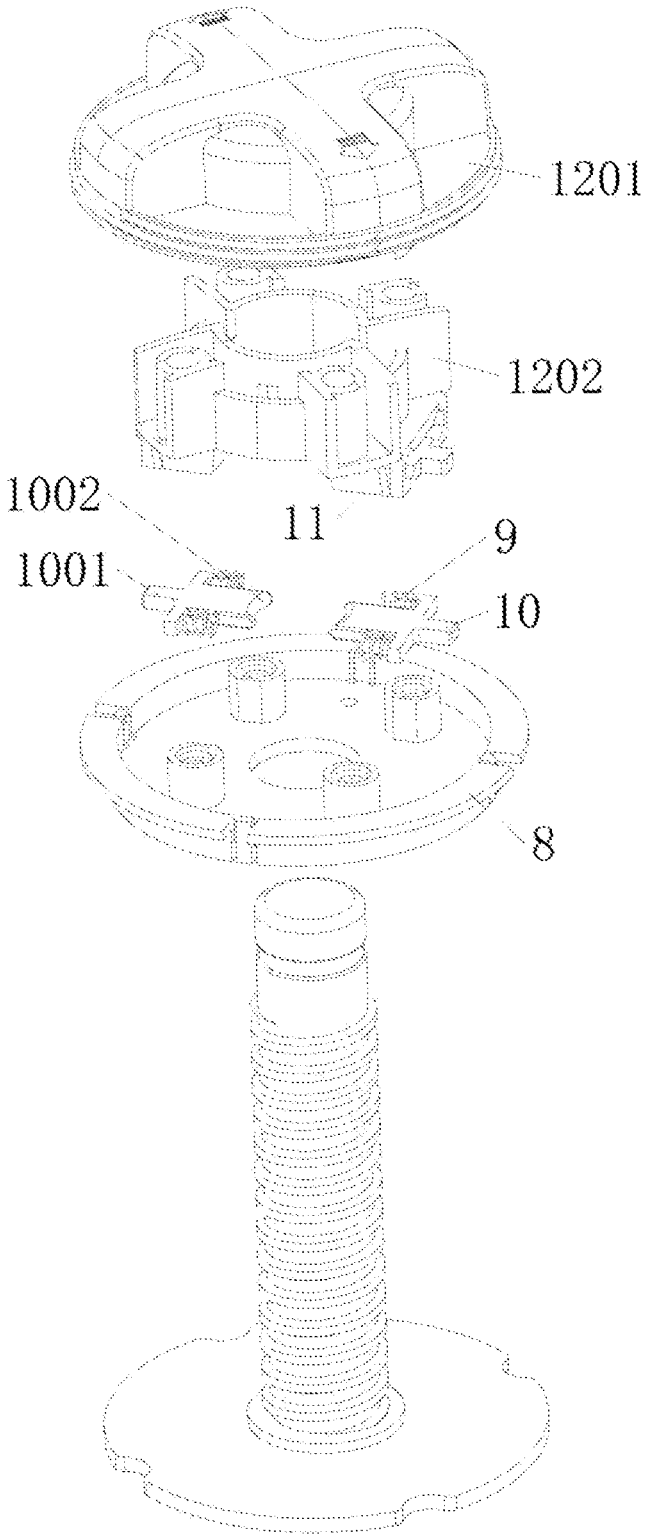
FIG. 7 is a first view of an exploded schematic diagram illustrating a locking device of the weight box shown in FIG. 3.
Figure 8:
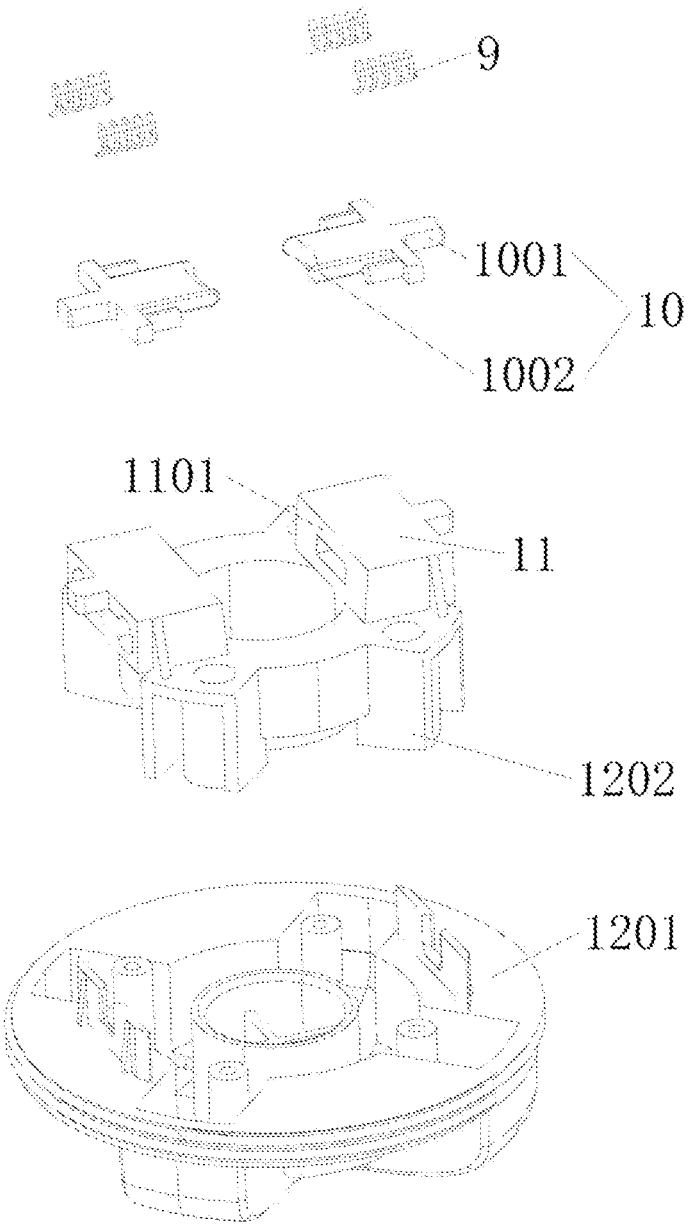
FIG. 8 is a second view of the exploded schematic diagram illustrating the locking device shown in FIG. 7.
Figure 9:
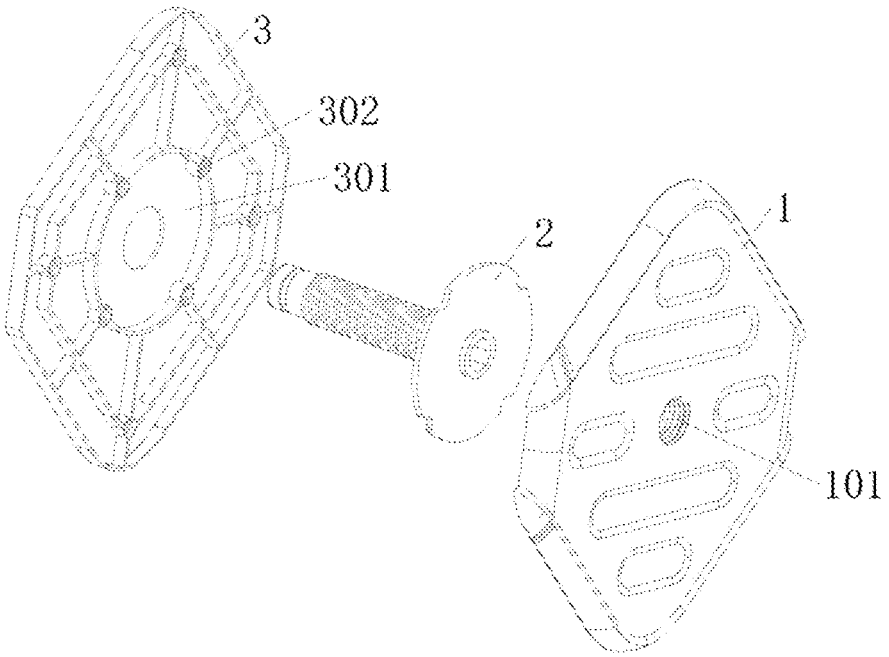
FIG. 9 is a first view of an exploded schematic diagram illustrating a box base of the weight box shown in FIG. 3.
Figure 10:
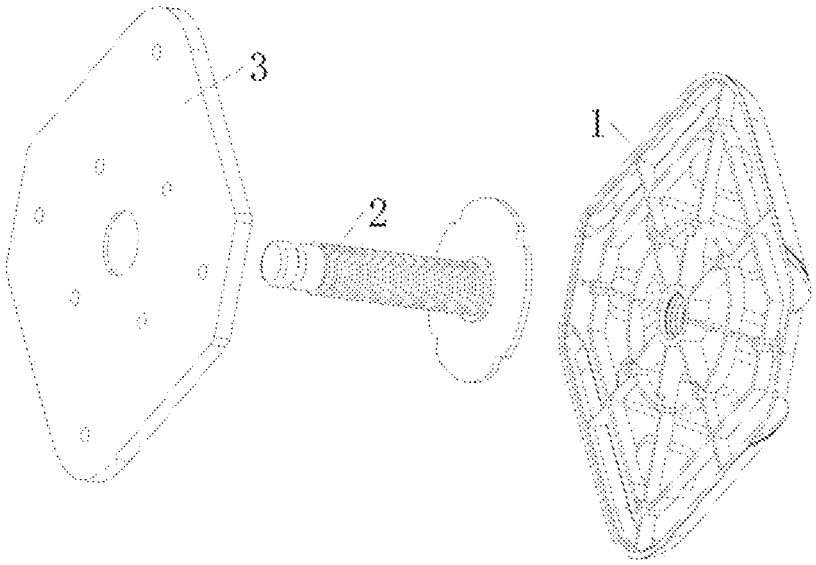
FIG. 10 is a second view of the exploded schematic diagram illustrating the box base shown in FIG. 9.
Figure 11:
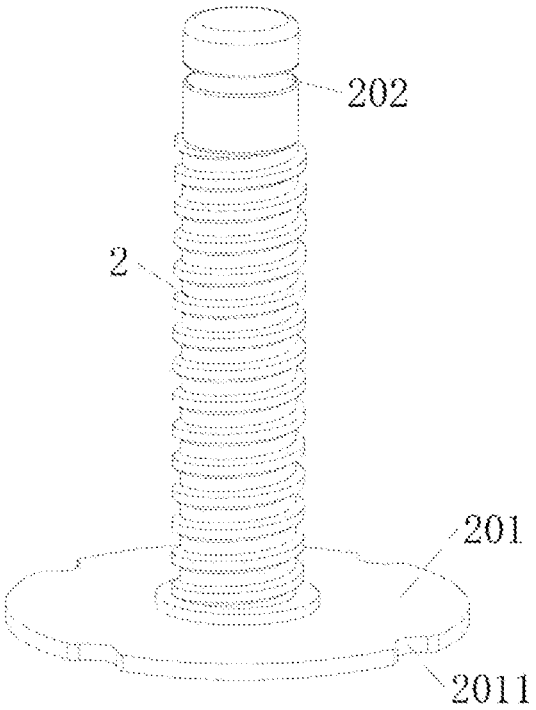
FIG. 11 is a three-dimensional structure diagram illustrating a threaded rod of the weight box shown in FIG. 3.
Figure 12:
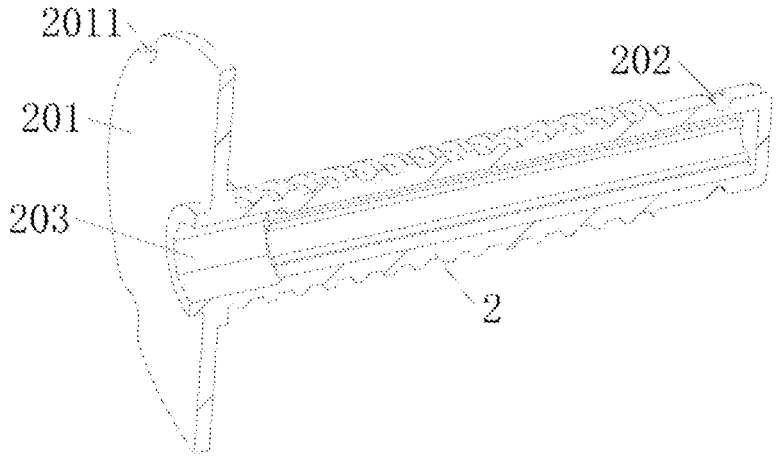
FIG. 12 is a three-dimensional sectional view diagram illustrating the threaded rod shown in FIG. 11, but view from another angle.
Figure 13:
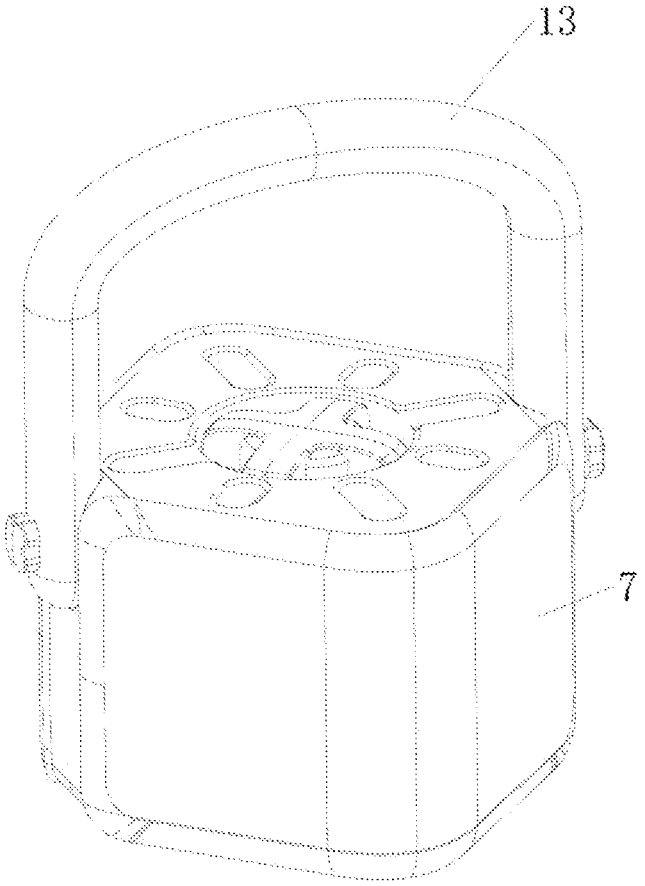
FIG. 13 is a three-dimensional structure diagram of a three-in-one fitness equipment of the present disclosure when the fitness equipment is used as a kettlebell.
Figure 14:
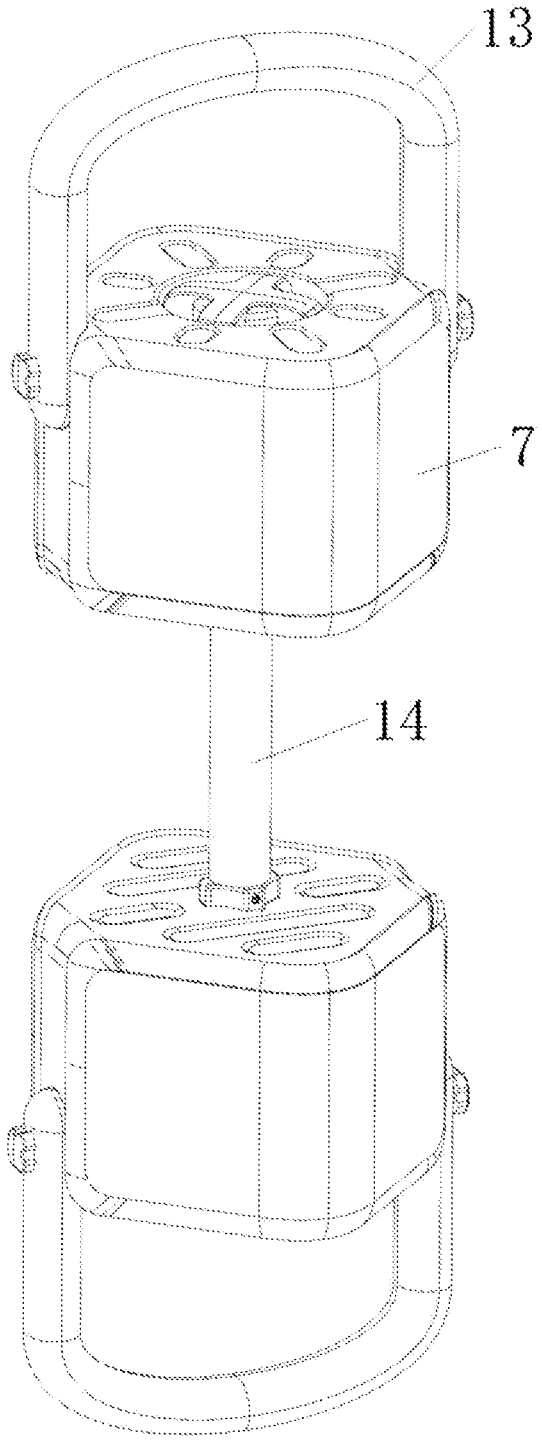
FIG. 14 is a three-dimensional structure diagram of the three-in-one fitness equipment the present disclosure when the fitness equipment is used as a dumbbell.
Figure 15:
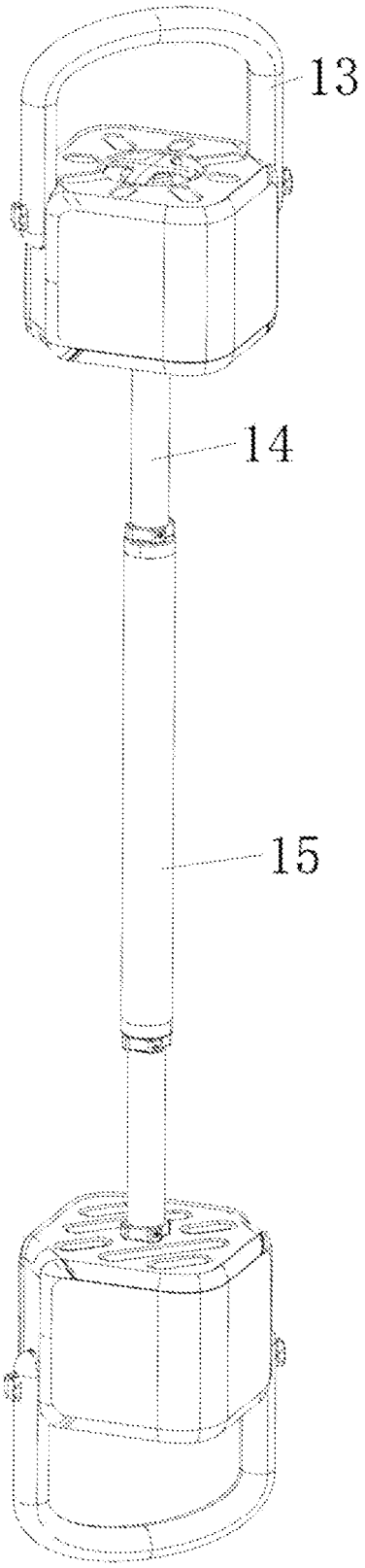
FIG. 15 is a three-dimensional structure diagram of the three-in-one fitness equipment the present disclosure when the fitness equipment is used as a barbell.
Figure 16:
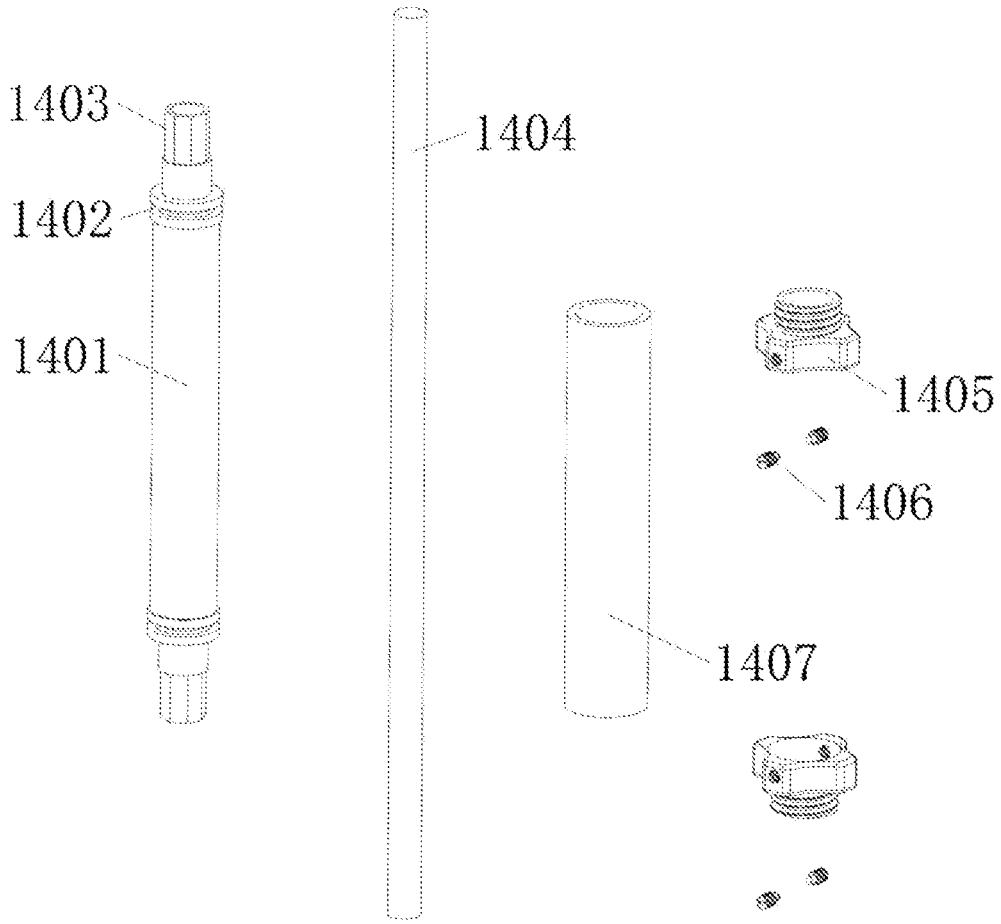
FIG. 16 is an exploded schematic diagram illustrating a rod of the three-in-one fitness equipment shown in FIG. 14.

Specifically, referring to FIGS. 5 to 6, the box body 7 includes a step portion 701 including a center hole and an internal thread 702. The step portion 701 is inwardly recessed at a center of an upper part of the box body 7. The internal thread 702 is arranged on an edge of the step portion 701 and is configured to threadedly connected with the rotary knob 12 (the upper housing 1201). The box body further includes a limiting convex bar 703 arranged at a lower part of the step portion 701. The limiting convex bar 703 protrudes toward an internal space of the box body 7 from the step portion 701. The limiting convex bar 703 includes a forcing end 7031 which is tangent to an inner diameter of the step portion 701, and a loosening end 7032 which is away from a center hole of the step portion 701. The forcing end 7031 is smoothly transitioned to the loosening end 7032. When the lock tongue 10 rotates around the center of the box body 7, the lock tongue 10 moves in a horizontal direction as the lock tongue sequentially coming into contact with the forcing end 7031 and loosening end 7032 of the limiting convex bar 703. The lock tongue 10 includes a driving end 1001 contacting to the limiting convex bar 703, and a locking end 1002 away from the driving end 1001. When the locking end 1002 moves horizontally to an extreme position close to a centerline of the box body 7, the locking end 1002 is configured to be inserted into the annular groove 202 provided at upper end of the threaded rod 2 to achieve the locking effect to the threaded rod 2.

Figure 3:
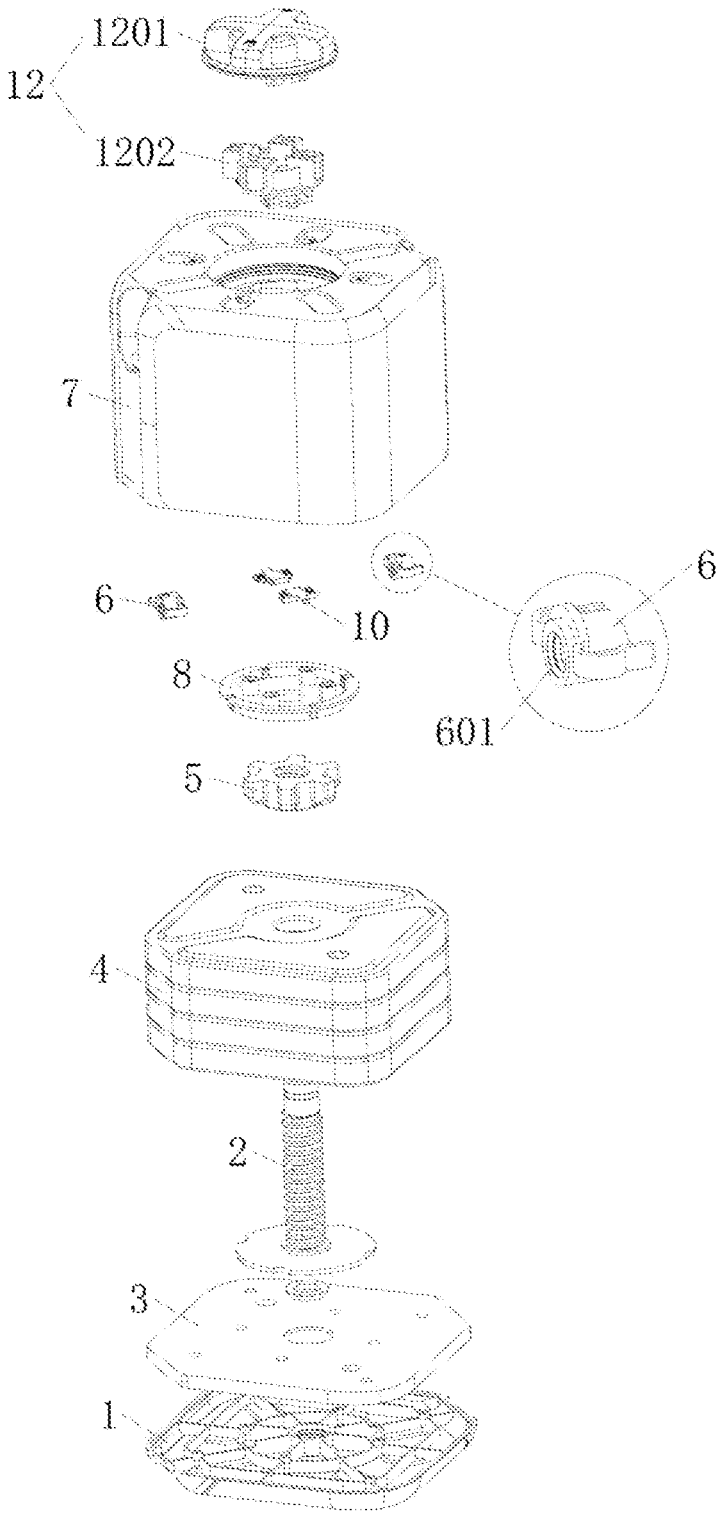
FIG. 3 is an exploded schematic diagram illustrating the weight box shown in FIG. 1.
Figure 4:
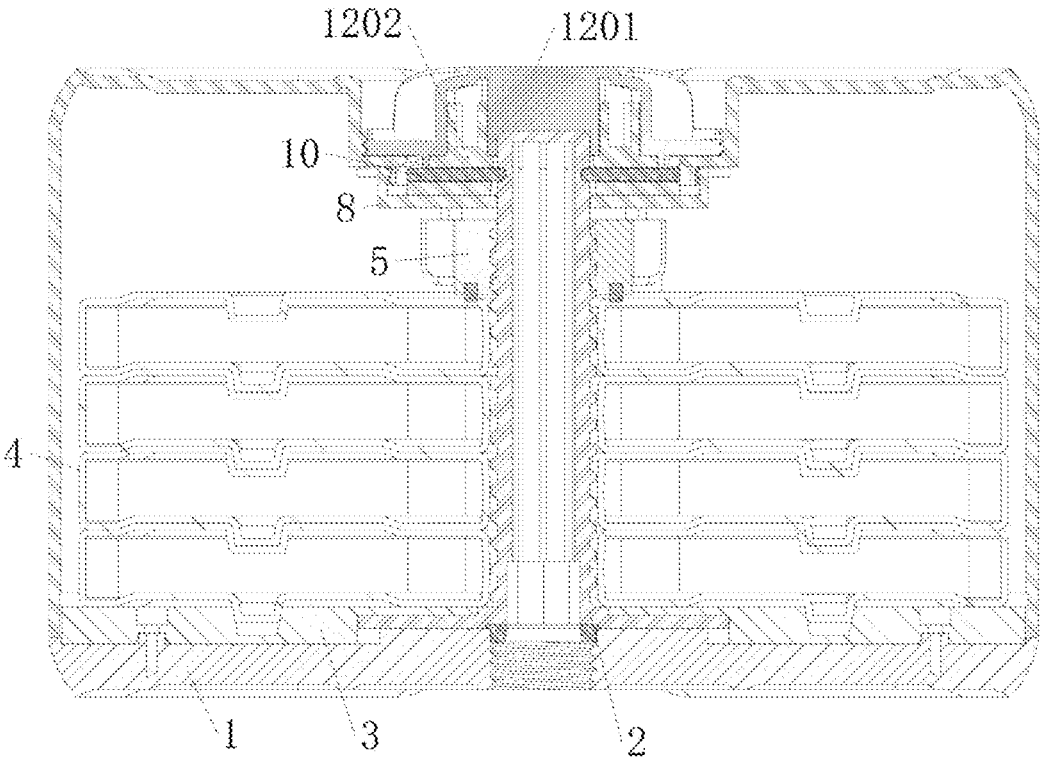
FIG. 4 is a sectional view diagram of the weight box shown in FIG. 1.

Wherein, referring to FIG. 3, the limiting plate 8 is connected with the rotary knob 12 by screws. Specifically, the limiting plate 8, the lower housing 1202, and the upper housing 1201 are connected by screws to achieve the synchronous rotational connection of the three. The limiting plate 8 is arranged under the step portion 701, which can further prevent the locking member 11 and the lock tongue 10 move in the vertical direction, and also avoid the rotary knob 12 detaching from the box body 7. When the rotary knob 12 is rotated, on the one hand, the rotary knob 12 matches the internal thread 702 so as to achieve the connection between the rotary knob 12 and the box body 7, on the other hand, it can drive the locking member 11, the lock tongue 10, and the limiting plate 8 to rotate. During the rotation, the driving end 1001 of the lock tongue 10 gradually moves toward the forcing end 7031 of the limiting convex bar 703, and when it reaches a limit position, the locking end 1002 of the lock tongue 10 can be clipped into the annular groove 202 provided on the threaded rod 2 to lock the threaded rod 2, and, at the same time, complete the connection between the box body 7 and the box base. When the rotary knob 12 is rotated in the opposite direction, on the one hand, the rotary knob 12 matches the internal thread 702 to separate from the box body 7, on the other hand, under the action of the spring 9, the lock tongue 10 causes the driving end 1001 to gradually move toward the loosening end 7032 of the limiting convex bar 703, making the locking end 1002 of the lock tongue 10 detach from the annular groove 202 provided on the threaded rod 2. At this time, the box body 10 is detached from the box base, and the users can replace the at least one weight plate 4.

Specifically, the rod-shaped holding member is a rod 14, the rod includes a connection rod 1401. Each end of the connection rod 1401 is provided with a limiting head 1403. An internal of the threaded rod 2 is provided with a limiting hole 203. The limiting head 1403 is insertable into the limiting hole 203. The connection rod 1401 and the threaded rod 2 rotate synchronously when the limiting head 1403 is inserted into the limiting hole 203. Wherein, the limiting head 1403 of the connection rod 1401 and the limiting hole 203 on the threaded rod 2 both have a regular polyhedral cross-section. More specifically, in this embodiment, a regular octahedron is adopted to avoid the problem of relative rotation between the connection rod 1401 and the threaded rod 2 when the connection rod 1401 is inserted into the threaded rod 2.

Two ends of the connection rod 1401 are provided with a concave groove 1402 arranged in an annular configuration. Both ends of the connection rod 1401 are installed with a rotatable locking screw nut 1405. At least one limiting screw 1406 is installed on a radial position of the locking screw nut and extends into the concave groove 1402. The two locking screw nuts 1405 are installed at the second installation position at the bottom of the weight box through threaded connection. Such an arrangement allows the locking screw nut 1405 to only have the degree of freedom to rotate relative to the connection rod 1401. When the locking screw nut 1405 is connected to the second installation position at the bottom of the weight box, the connection rod 1401 and the weight box can be connected. Wherein, at the root position of the second installation position (i.e., the connection hole 101) is provided with a rubber pad, which makes the locking screw nut 1405 abuts closely to the rubber pad during the locking process, thereby ensuring a firm connection and preventing shaking. In the middle part of the connection rod 1401 is sleeved on with a holding rod 1407. At a center of the connection rod 1401 is installed with a center rod 1404, the two ends of the center rod 1404 extend to the center position of the threaded rod 2. Both the center rod 1404 and the holding rod 1407 are fixedly connected to the connection rod 1401. The center rod 1404 serves to further guide and reinforce the rod 14. The holding rod 1407 serves to protect the center rod 1404, and can be replaced after a period of use.

Specifically, the rod-shaped holding member further includes an extension rod 15 connected with the rod 14. The extension rod 15 is thready connected to the rod 14, so as to further increase the overall length of the rod-shaped holding member, by which the fitness equipment can be used as a barbell.

The three-in-one fitness equipment provided by the present disclosure contains three functions:

1) When used as a kettlebell, the handle 13 is installed on two opposite sides of the weight box by screws, so that the users can grip the handle 13 to perform kettlebell fitness activities.
2) When used as a dumbbell, the handle 13 can be detached or remained, the rod 14 is configured for connecting two weight boxes to assemble a dumbbell, so that the users can grip the rod 14 to perform dumbbell fitness activities. Moreover, according to the users' needs, the box body 7 can be detached, with only the box base remains to expose the at least one weight plate 4 to meet the needs of the users.

When used as a barbell, the handle 13 can be detached or remained, and the box body 7 can be detached or remained, with only two rods 14 and an extension rod installed between the two rods 14 to increase the length of the rod-shaped holding member, so that the users can perform the barbell fitness activities.

The specific embodiments described herein are preferable examples to illustrate the spirit of the present disclosure only and not limiting the scope of this disclosure. Those skilled in the art to which the present disclosure belongs can make various modifications or additions to the specific embodiments described or use similar alternatives, but they will not deviate from the spirit or exceed the scope of the present disclosure.

REFERENCE SIGNS LIST

1: bottom cover
101: connection hole
2: threaded rod
201: positioning plate
2011: groove
202: annular groove
203: limiting hole
3: top cover
301: recessed portion
302: threaded pillar
4: weight plate
5: first screw nut
6: second screw nut
601: screw hole
7: box body
701: step portion
702: internal thread
703: limiting convex bar
7031: forcing end
7032: loosening end
8: limiting plate
9: spring
10: lock tongue
1001: driving end
1002: locking end
11: locking member
1101: stop plate
12: rotary knob
1201: upper housing
1202: lower housing
13: handle
14: rod
1401: connection rod
1402: concave groove
1403: limiting head
1404: center rod
1405: locking screw nut
1406: limiting screw
1407: holding rod
15: extension rod

What is claimed is:

1. A three-in-one fitness equipment comprising:

a weight box configured for receiving at least one weight plate;

a first installation position provided on one end of the weight box, the first installation position being configured for installing a handle thereon; and a second installation position provided at a bottom of the weight box, the second installation position being configured for connecting to a rod-shaped holding member, wherein the fitness equipment is a kettlebell when the first installation position is installed with the handle, and the fitness equipment is a dumbbell or a barbell when the second installation position is connected to the rod-shaped holding member, the weight box comprises a box body, a box base detachably connected with the box body, a threaded rod on a center position of the box base, and a locking device arranged on the box body and configured for connecting with the threaded rod, an upper end of the threaded rod extends to an upper position of the box body, the box body is locked with the box base when the locking device is connected with the threaded rod, the threaded rod comprises an annular groove on an outer diameter position of the upper end of the threaded rod, the locking device comprises a lock tongue arranged around the threaded rod, the lock tongue is connectable to the box body, the lock tongue is rotatable around a center of the threaded rod and movable horizontally, an end of the lock tongue is insertable into the annular groove, the threaded rod is connected with the box body-when the end of the lock togue is inserted into the annular groove.

2. The three-in-one fitness equipment according to claim 1, wherein the locking device further comprises a rotary knob positioned above the box body and connected with the box body through a threaded connection, the rotary knob is configured to drive the lock tongue to rotate around the center of the threaded rod, the locking device further comprises a limiting plate and a locking member, the limiting plate is provided inside the box body and connected with the rotary knob, the locking member is installed between the limiting plate and the rotary knob, the lock tongue is slidably installed inside the locking member, and when the rotary knob rotates, the rotary knob drives the lock tongue to rotate around the center of the threaded rod.

3. The three-in-one fitness equipment according to claim 2, wherein, the box body comprises a step portion comprising a center hole, and an internal thread, the step portion being inwardly recessed at a center of an upper part of the box body, the rotary knob is arranged beneath the step portion and connected with the internal thread of the step portion, the box body further comprises a limiting convex bar protruding towards an internal space of the box body, the limiting convex bar being arranged at a lower part of the step portion, and the limiting convex bar comprising a forcing end which is tangent to an inner diameter of the step portion, and a loosening end which is away from the center hole of the step portion, the forcing end is smoothly transitioned to the loosening end, and when the lock tongue rotates around the center of the box body, the lock tongue moves in a horizontal direction as the lock tongue sequentially coming into contact with the forcing end and the loosening end of the limiting convex bar.

4. The three-in-one fitness equipment according to claim 3, wherein the lock tongue comprises a driving end contacting to the limiting convex bar, and a locking end away from the driving end, the locking end is inserted into the annular groove provided at the upper end of the threaded rod when the locking end moves horizontally to an extreme position, the extreme position of the locking end is close to a centerline of the box body.

5. The three-in-one fitness equipment according to claim 1, wherein the box base comprises a bottom cover and a top cover connected to the bottom cover by screws, the weight box further comprises a positioning plate between the top cover and the bottom cover, the positioning plate being connected to a bottom portion of the threaded rod, the threaded rod is configured to extend through the top cover of the box base.

6. The three-in-one fitness equipment according to claim 5, wherein the first installation position is a screw hole arranged on two sides of the weight box, the second installation position is a connection hole defined on a center of the bottom cover of the box base; the connection hole is a threaded hole.

7. The three-in-one fitness equipment according to claim 6, wherein the rod-shaped holding member is a rod, the rod comprises a connection rod, each end of the connection rod is provided with a limiting head, the threaded rod comprises a limiting hole, the limiting head is insertable into the limiting hole, the connection rod and the threaded rod rotate synchronously when the limiting head is inserted into the limiting hole, each end of the connection rod is provided with a locking screw nut, and the locking screw nuts are rotatably arranged on the second installation position at the bottom of the weight box through a threaded connection.

8. The three-in-one fitness equipment according to claim 7, wherein the rod-shaped holding member further comprises an extension rod connected with the rod.

* * * * *